US006621215B1

(12) United States Patent
Su et al.

(10) Patent No.: US 6,621,215 B1
(45) Date of Patent: Sep. 16, 2003

(54) FRONT PLATE OF A PLASMA DISPLAY PANEL (PDP) AND THE METHOD OF FABRICATING THE SAME

(75) Inventors: Yao Ching Su, Tainan Hsien (TW); Yih Jer Lin, Kaohsiung (TW)

(73) Assignee: AU Optronics Corp., Hsinchu (TW)

( * ) Notice: Subject to any disclaimer, the term of this patent is extended or adjusted under 35 U.S.C. 154(b) by 319 days.

(21) Appl. No.: 09/709,074

(22) Filed: Nov. 8, 2000

(30) Foreign Application Priority Data

Jan. 7, 2000 (TW) ..... 89100193 A

(51) Int. Cl.[7] ..... H01J 17/49

(52) U.S. Cl. ..... 313/582; 313/583; 313/584; 313/585; 313/586; 313/587

(58) Field of Search ..... 313/528–587; 445/24, 25

(56) References Cited

U.S. PATENT DOCUMENTS 6,037,713 A * 3/2000 Fukuta et al. ..... 313/582
6,160,345 A * 12/2000 Tanaka et al. ..... 313/489
6,337,538 B1 * 1/2002 Awaji et al. ..... 313/586
6,419,540 B1 * 7/2002 Tanaka et al. ..... 445/24
6,420,831 B2 * 7/2002 Awaji et al. ..... 313/586
6,452,331 B1 * 9/2002 Sakurada et al. ..... 313/582
6,509,689 B1 * 1/2003 Kim et al. ..... 313/586

* cited by examiner

*Primary Examiner*—Robert H. Kim
*Assistant Examiner*—Jurie Yun
(74) *Attorney, Agent, or Firm*—Ladas & Parry

(57) ABSTRACT

A front plate of a plasma display panel (PDP) comprising a glass substrate, a auxiliary electrode formed in the glass substrate, and a protecting electrode over the auxiliary electrode is disclosed. The auxiliary electrode is inlaid in the glass substrate or in a buffer layer formed atop the glass substrate. The protecting electrode is formed to prevent a bonding auxiliary electrode of the auxiliary electrode from being oxidized easily during a high temperature process. Another front plate of a PDP is disclosed and includes a glass substrate, a sustaining electrode on the glass substrate, an auxiliary electrode on the sustaining electrode, and a protecting electrode disposed on the auxiliary electrode. Again, the protecting electrode is formed to prevent the bonding auxiliary electrode of the auxiliary electrode from being oxidized easily during a high temperature process.

19 Claims, 10 Drawing Sheets

FRONT PLATE OF A PLASMA DISPLAY PANEL (PDP) AND THE METHOD OF FABRICATING THE SAME

BACKGROUND OF THE INVENTION

1. Field of the Invention

The present invention relates to a front plate of a plasma display panel (PDP) and the method of fabricating the same. More particularly, the present invention relates to a method of fabricating a front plate of a plasma display panel that is capable of preventing oxidation of the electrodes in bonding area of the plasma display panel.

2. Description of the Related Art

Recently, a variety of flat panel displays, such as a liquid crystal display (LCD) and a plasma display. panel (PDP) have been intensively developed for replacing the cathode ray tubes (CRT) display. In PDP, an ultra violet light is emitted for exciting the RBG phosphors to produce visible lights. The advantages of the PDP include large display area, wide viewing angle, and intense brightness.

FIG. 1 shows an exploded view of a conventional plasma display panel (referred as PDP) comprising a front plate 10 and a back plate 12. The front plate 10 includes a glass substrate 14, a plurality of scanning electrodes 16, a transparent dielectric layer 18, and a magnesium oxide (MgO) layer 20. Each of the scanning electrodes 16 includes a sustaining electrode 22 and an auxiliary electrode 24. A visible light is emitted by plasma generated between two adjacent transparent electrodes 22 after a voltage is applied to these electrodes 22. In order to allow visible light to pass through the glass substrate 14, each of the sustaining electrodes 22 is a transparent electrode 22 consisted of indium tin oxide (ITO) or $SnO_2$. However, the resistance of the sustaining electrode is too high to be suitable for electrical conduction. For this reason, an auxiliary electrode 24 consisting of metal is disposed on every sustaining electrode 22 to enhance conductivity.

The back plate 12 comprises another glass substrate 30, a plurality of data electrodes 32, a dielectric layer 33, a plurality of ribs 34, and a plurality of fluorescence layers 36. The data electrodes 32 of the back plate are perpendicularly to the scanning electrodes 16 of the front plate 10. The space formed by two adjacent ribs 34 and two adjacent scanning electrodes 16 is called a "pixel". The data electrode 32 is used for controlling the generation of the plasma. The scanning electrodes 16 are used to maintain the plasma. In addition, the fluorescence layers 36 can produce primary visible lights after absorbing UV ray generated by the plasma. The primary visible lights includes red, green, and blue light. The ribs 34 prevent the UV ray from leaking to the neighboring pixel and thereby prevent the color mixing phenomenon.

Referring to FIGS. 2A through FIG. 2C, FIG. 2A shows a top view of the front plate of the PDP shown in FIG. 1, and FIGS. 2B and 2C show cross-sectional views of the front plate 10 along the a—a and b—b lines shown in FIG. 2A, respectively. A pixel area and a bonding area are formed on the glass substrate 14, the a—a line crosses the pixel area and the b—b line crosses the bonding area. The auxiliary electrode 24 is divided into a pixel auxiliary electrode and a bonding auxiliary electrode. The bonding auxiliary electrode is the portion of the auxiliary electrode 16 extending to the edge of the front plate 10 and used for connection to an external driving circuit (not shown). As shown in FIG. 2B, in the pixel area, the pixel auxiliary electrode is covered by the dielectric layer 18 and MgO layer 20. On the contract, in the bonding area as shown in FIG. 2C, the bonding auxiliary electrode is not covered by the dielectric layer 18 or MgO layer 20.

Conventionally, each of the scanning electrodes 16 is constituted of a sustaining electrode 22 and an auxiliary electrode 24 such that the auxiliary electrode 24 is stacked on top of the sustaining electrode 22. The auxiliary electrode 24 has a three-layered structure constituted of Cr—Cu—Cr, wherein Cr and Cu denote chromium and copper, respectively. In particular, a heating process of about 500° C. to 600° C. is used to sinter the dielectric layer 18. However, the top Cr metal surface of the auxiliary electrode 24 tends to be oxidized easily during the heating process. It may cause a short circuit between the bonding auxiliary electrode and the external driving circuit, and the performance of the PDP will be reduced.

SUMMARY OF THE INVENTION

Therefore, the object of the present invention is to provide a front plate of a plasma display panel (PDP) capable of preventing the bonding electrode from being oxidized during the sequential heating process.

To achieve the above-mentioned object, the present invention provides a front plate of a PDP, comprising a glass substrate, an auxiliary electrode, and a protecting electrode. The auxiliary electrode is located on the glass substrate having a pixel area and a bonding area. The auxiliary electrode includes a pixel auxiliary electrode positioned at the pixel area and a bonding auxiliary electrode positioned at the bonding area. The protecting electrode is disposed above the bonding auxiliary electrode so that the bonding auxiliary electrode is covered by the protecting electrode and is not oxidized during the sequential processes.

According to the first embodiment of the present invention, the glass substrate includes a trench and the auxiliary electrode is embedded in the trench of the glass substrate. The auxiliary electrode includes a main conducting layer, a first medium layer positioned between the main conducting layer and the glass substrate, and a second medium layer positioned between the main conducting layer and the protecting electrode. The first medium layer is used to eliminate the stress between the main conducting layer and the glass substrate, and the second medium layer is used to eliminate the stress between the main conducting layer and the protecting electrode.

According to the second embodiment of the present invention, the glass substrate includes a trench, and the auxiliary electrode is embedded in the trench of the glass substrate. The auxiliary electrode includes a main conducting layer positioned under the protecting electrode and a first medium layer positioned between the main conducting layer and the glass substrate. The first medium layer is used to eliminate the stress between the main conducting layer and the glass substrate.

According to the third embodiment of the present invention, the front plate further incldues a buffer layer located on the glass substrate. The buffer layer has a trench and the auxiliary electrode is embedded in the trench of the buffer layer. The auxiliary electrode includes a main conducting layer, a first medium layer positioned between the main conducting layer and the buffer layer, and a second medium layer positioned between the main conducting layer and the protecting electrode. The first medium layer is used to eliminate the stress between the main conducting layer and the buffer layer, and the second medium layer is used to eliminate the stress between the main conducting layer and the protecting electrode.

According to the fourth embodiment of the present invention, the front plate further includes a buffer layer located on the glass substrate, the buffer layer has a trench, and the auxiliary electrode is embedded in the trench of the buffer layer. The auxiliary electrode includes a main conducting layer positioned under the protecting electrode and a first medium layer positioned between the main conducting layer and the buffer layer. The first medium layer is used to eliminate the stress between the main conducting layer and the buffer layer.

According to the fifth embodiment of the present invention, the front plate further includes a sustaining electrode located between the glass substrate and the auxiliary electrode. The auxiliary electrode includes a main conducting layer, a first medium layer positioned between the main conducting layer and the sustaining electrode, and a second medium layer positioned between the main conducting layer and the protecting electrode.

According to the sixth embodiment of the present invention, the front plate further includes a sustaining electrode located between the glass substrate and the auxiliary electrode. The auxiliary electrode includes a main conducting layer positioned under the protecting electrode and a first medium layer positioned between the main conducting layer and the sustaining electrode.

According to the embodiments of the present invention, the main conducting layer is made of copper (Cu), the first and the second medium layers are made of chromium (Cr) Furthermore, the protecting electrode is made of a layer of metal-oxide, which is selected from the group of ITO (Indium Tin Oxide), ZnO (Zinc Oxide), and $SnO_2$ (Stannum dioxide).

A method of fabricating the above-described front plate a PDP according to the present invention includes the steps of: (a) providing a glass substrate having a pixel area and a bonding area; (b) forming a trench in the glass substrate; (c) forming an auxiliary electrode in the trench, wherein the auxiliary electrode comprises a pixel auxiliary electrode disposed in the pixel area and a bonding auxiliary electrode disposed in the bonding area; and (d) forming a protecting electrode-over the bonding auxiliary electrode to prevent the bonding auxiliary electrode from oxidation during the sequential process.

A further method of fabricating the above-described front plate a PDP according to the present invention comprises the steps of: (a) providing a glass substrate having a pixel area and a bonding area; (b) forming a dielectric layer on the glass substrate; (c) forming a trench on the dielectric layer; (d) forming an auxiliary electrode in the trench, wherein the auxiliary electrode comprises a pixel auxiliary electrode disposed in the pixel area and a bonding auxiliary electrode disposed in the bonding area; and (e) forming a protecting electrode over the bonding auxiliary electrode to prevent the bonding auxiliary electrode from oxidation during the sequential process.

A further method of fabricating the above-described front plate a PDP according to the present invention comprises the steps of: (a) providing a glass substrate having a pixel area and a bonding area; (b) forming a transparent electrode on the glass substrate; (c) forming an auxiliary electrode above the transparent electrode, the auxiliary electrode comprising a pixel auxiliary electrode disposed in the pixel area and a bonding auxiliary electrode disposed in the bonding pad area; and (d) forming a protecting electrode on the auxiliary electrode to prevent the bonding auxiliary electrode from oxidation.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE PREFERRED EMBODIMENT

Accordingly, the present invention provides a plasma display panel (PDP) capable of preventing the bonding electrodes of the PDP from being oxidized easily during a high temperature heating process.

First and Second Embodiments

Figure 1:
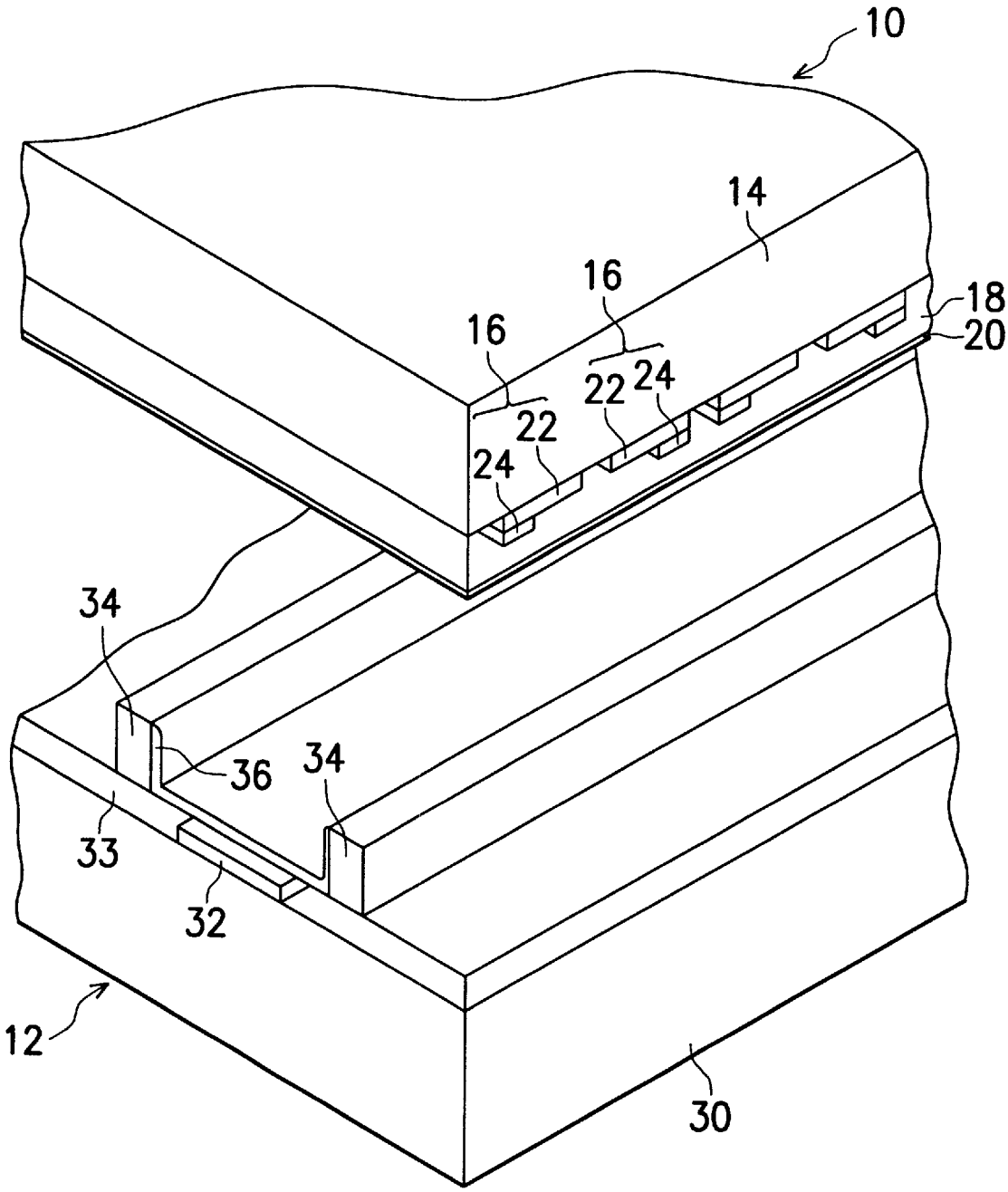
FIG. 1 (PRIOR ART)
FIG. 1 shows an exploded view of a conventional plasma display panel (referred to as PDP hereinafter) comprising a front plate and a back plate.
Figure 2A:
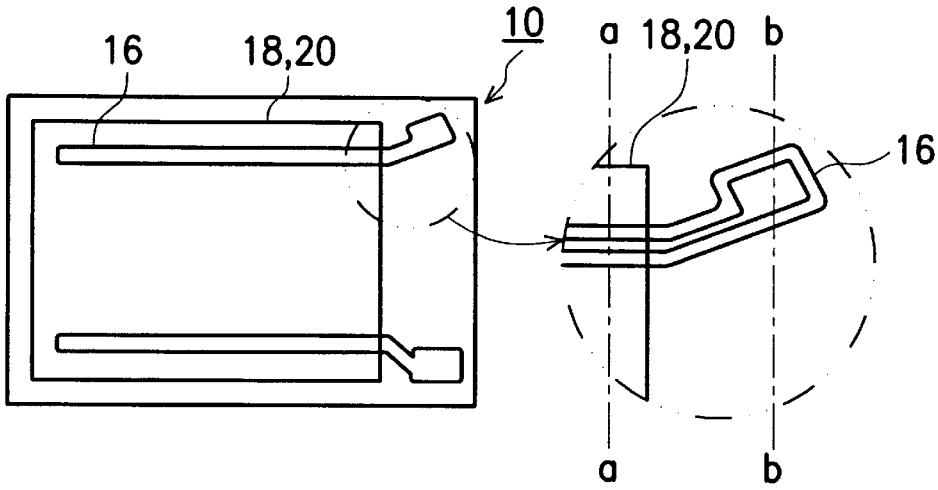
FIG. 2A (PRIOR ART)
FIG. 2A shows a top view of the front plate of the PDP shown in FIG. 1.
Figure 2B:
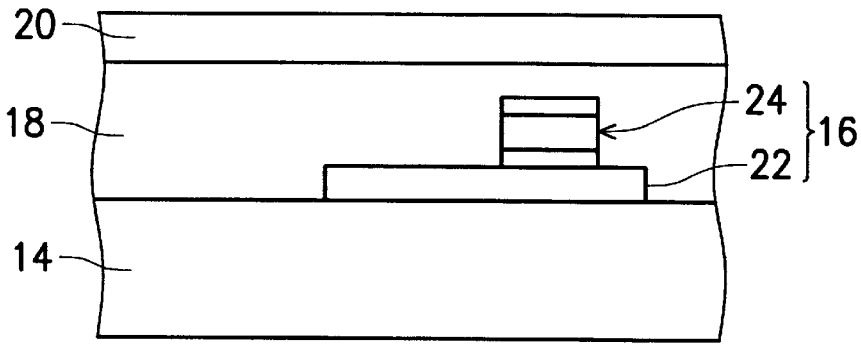
FIG. 2B (PRIOR ART)
FIGS. 2B and 2C are cross-sectional views of the front plate along the a—a and the b—b lines shown in FIG. 2A, respectively.
Figure 2C:
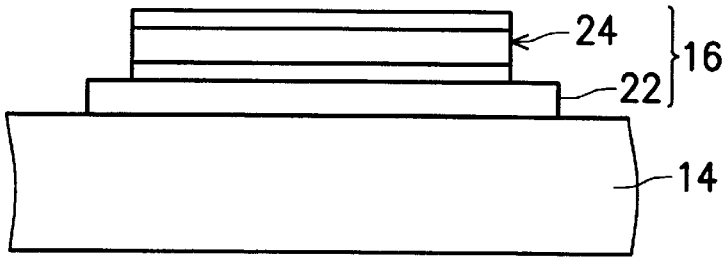
FIG. 2C (PRIOR ART)
Figure 3A:
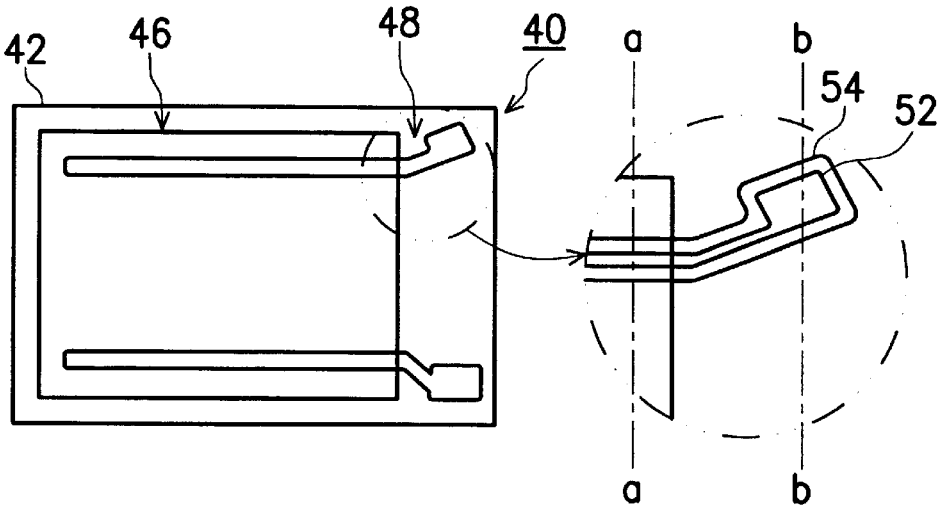
FIG. 3A shows a top view of the front plate of the PDP according to the first embodiment of the present invention.
Figure 3B:
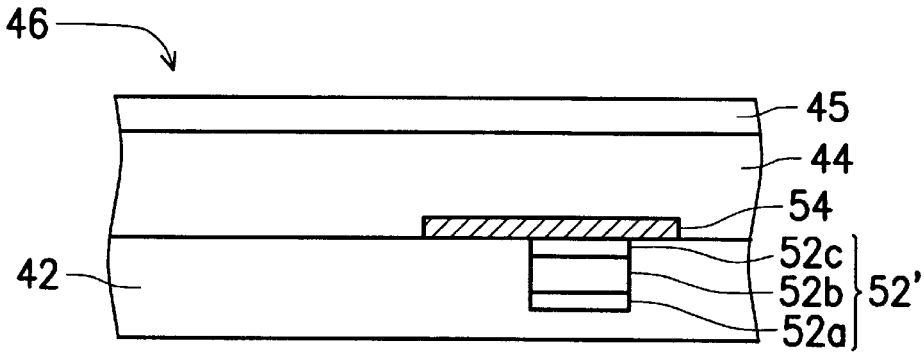
FIGS. 3B and 3C are cross-sectional views of a pixel area and a bonding area of the front plate along the a—a and the b—b lines shown in FIG. 3A in accordance with the first embodiment.
Figure 3C:
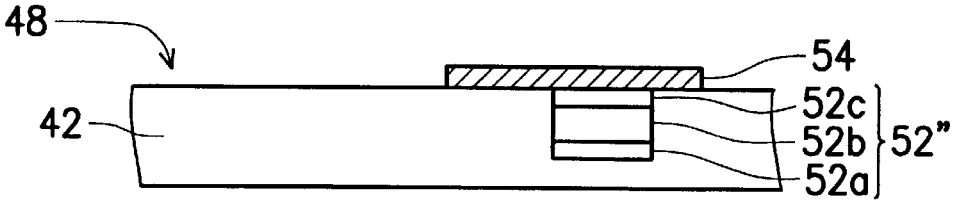

Referring to FIG. 3A through FIG. 3C, FIG. 3A shows a top view of the front plate 40 of the PDP according to the first embodiment of the present invention. FIGS. 3B shows a cross-sectional view of a pixel area of the front plate 40 along the a—a line shown in FIG. 3A. FIGS. 3C shows a cross-sectional view of a bonding area of the front plate 40. along the b—b line shown in FIG. 3A.

According to this embodiment, the front plate 40 of the PDP comprises a glass substrate 42 having a trench 50, an auxiliary electrode 52 embedded in the trench 50 of the glass substrate 42, and a protecting electrode 54 formed over the auxiliary electrode 52 and a part of the glass substrate 42. A dielectric layer 44 is formed to cover both the protecting electrode 54 and the glass substrate 42 in the pixel area 46, and a MgO layer 45 is further formed on the dielectric layer 44.

The depth of the trench 50 is substantially the same as the height of the auxiliary electrode. 52 as shown in FIGS. 3B and 3C, therefore, the auxiliary electrode 52 can fill in the trench 50 completely.

The auxiliary electrode 52 is constituted of a pixel auxiliary electrode 52' disposed in the pixel area 46 and a bonding auxiliary electrode 52" disposed in the bonding area 48. The pixel auxiliary electrode 52' is connected with the bonding auxiliary electrode 52". The auxiliary electrode 52 includes a first medium layer 52*a*, a main conducting layer 52*b*, and an second medium layer 52*c*. Because the properties of metal and glass are different, the first medium layer 52*a* is used to eliminate the stress between the main conducting layer 52*b* and the glass substrate 42, and the second medium layer 52*c* is used to eliminate the stress between the main conducting layer 52*b* and the protecting electrode 54.

Further, a dielectric layer 44 is formed over the glass substrate 42 in the pixel area 46, and a magnesium oxide (MgO) layer 45 is then formed over the dielectric layer 44. Therefore, the bonding area 48 is covered by neither the dielectric layer 44 nor the magnesium oxide layer 45, the protecting electrode 54 in the bonding area 48 is then exposed and the bonding auxiliary electrode 52" is covered by the protecting electrode 54. In the prior art, a conventional bonding auxiliary electrode is directly exposed in the air without any covering material, and the exposed bonding auxiliary electrode is vulnerable and easily be oxidized during a subsequent high temperature process. To the contrary, the bonding auxiliary electrode 52" according to the present invention is covered by the protecting electrode 54, which can effectively prevent the bonding auxiliary electrode 52" from being oxidized during the heating process.

The main conducting layer 52*b* is typically comprised of copper. (Cu), whereas the lower medium layer 52*a* and the upper medium layer 52*c* are typically comprised of chromium (Cr). The protecting electrode 54, on the other hand, is typically comprised of indium tin oxide (ITO) or tin oxide ($SnO_2$). The protecting electrode 54 is a metal oxide so it will not be oxidized easily. The property of these electrodes remains the same during the heating process so the connection between the bonding auxiliary electrode 52" and the external circuit will be not influenced.

Figure 4A:
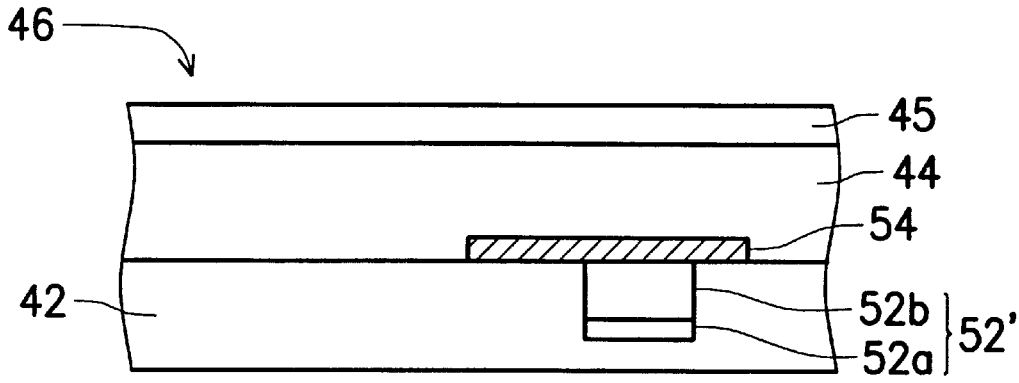
FIGS. 4A and 4B are cross-sectional views of a pixel area and a bonding area of the front plate in accordance with the second embodiment.
Figure 4B:
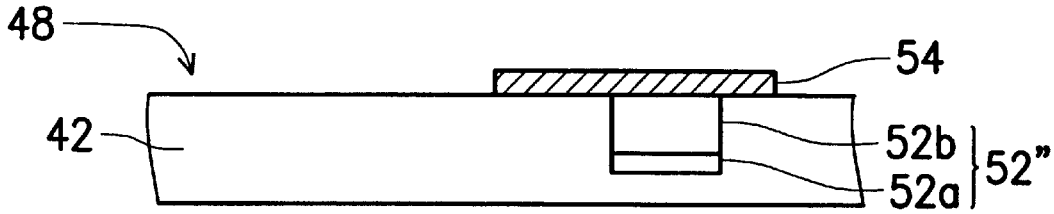

Referring to FIGS. 4A and 4B, FIGS. 4A shows a cross-sectional view of a pixel area of the front plate 40 along the a—a line shown in FIG. 3A in accordance with the second embodiment. And FIGS. 4B shows a cross-sectional view of a bonding area of the front plate 40 along the b—b line shown in FIG. 3A in accordance with the second embodiment.

The difference between the first and the second embodiments is the structure of the auxiliary electrode 52. The auxiliary electrode 52 according to the second embodiment is a two-layered structure comprising a main conducting layer 52*b* and an first medium layer 52*a*. The first medium layer 52*a* is used to eliminate the stress between the main conducting layer 52*b* and the glass substrate 42. The second medium layer 52*c* is omitted in the second embodiment.

Third and Fourth Embodiments

Figure 5A:
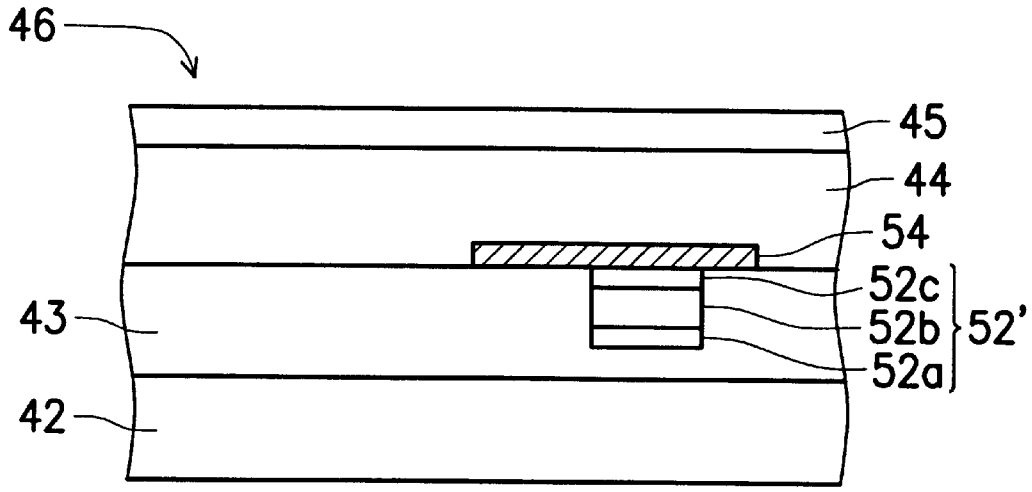
FIGS. 5A and 5B are cross-sectional views of a pixel area and a bonding area of the front plate in accordance with the third embodiment.
Figure 5B:
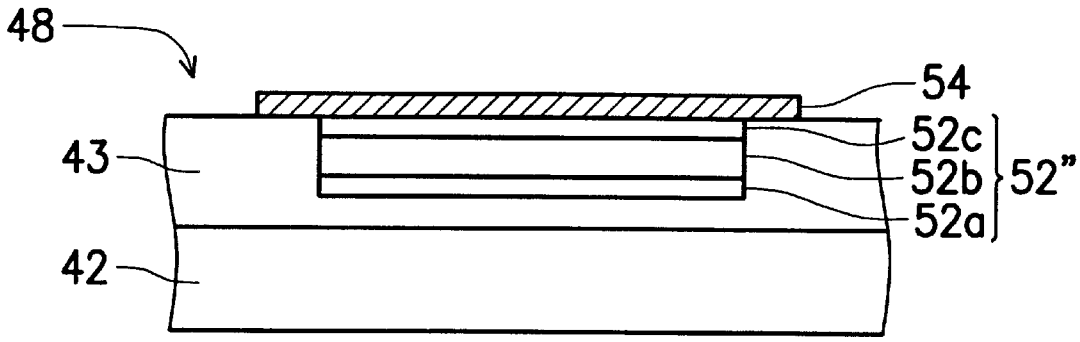

Referring to FIGS. 5A and 5B, FIGS. 5A shows a cross-sectional view of a pixel area of the front plate 40 along the a—a line shown in FIG. 3A in accordance with the third embodiment, and FIGS. 5B shows a cross-sectional view of a bonding area of the front plate 40 along the b—b line shown in FIG. 3A in accordance with the third embodiment.

According to this embodiment, the front plate 40 of the PDP comprises a glass substrate 42 divided into a pixel area 46 and a bonding area 48, a buffer layer 43 formed on the glass substrate 42, an auxiliary electrode 52 embedded in the buffer layer 43, a protecting electrode 54 formed over the auxiliary electrode 52, a dielectric layer 44 coated over both the protecting electrode 54 and the buffer layer 43 in the pixel area 46 of the glass substrate 42, and a MgO layer 45 formed on the dielectric layer 44.

The difference between the third embodiment and the first embodiment lies in that the trench 53 is formed in the buffer layer 43 instead of in the glass substrate 42 of the first embodiment. The auxiliary electrode 52 is embedded into the trench 53 of the buffer layer 43. The buffer layer 43 is made of a dielectric material, and it is easier to form the trench 53 in the buffer layer 43 than in the glass substrate 42 by etching or other process. Although an additional deposition process is required to form the buffer layer 43 on the glass substrate 42, etching the buffer layer 43 instead of the glass substrate 42 ensures a more controllable yield of the PDPs.

During the assembly process of the PDP, the protecting electrode 54 in the bonding area 48 is connected to the external driving circuit. When the assembly process exists any problem and the PDP needs to be reworked, the external driving circuit must be detached from the protecting electrode 54. In the meanwhile, the auxiliary electrode 52 will not be pulled out easily during the reworking process because the auxiliary electrode 52 is embedded in the trench 53 of the buffer layer 43. Further, the glass substrate 42 will not be broken during the reworking process because the glass substrate 42 is covered by the buffer layer 43.

Figure 6A:
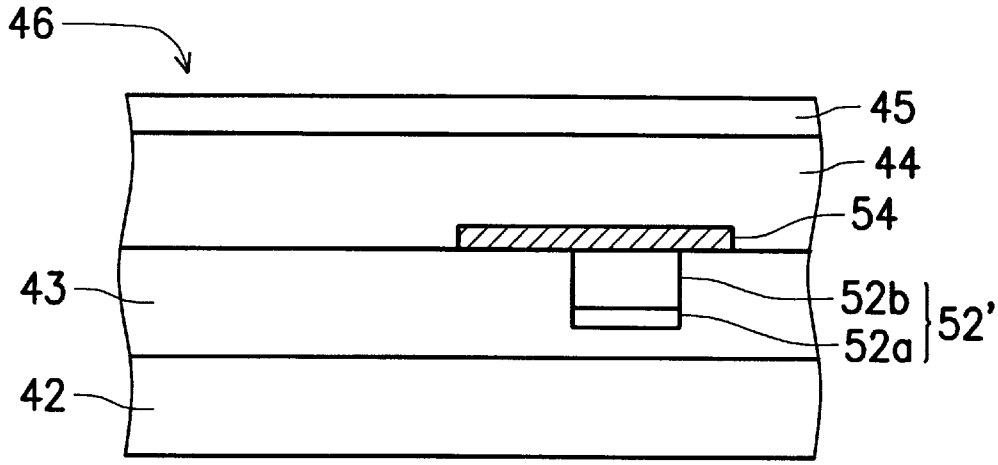
FIGS. 6A and 6B are cross-sectional views of a pixel area and a bonding area of the front plate in accordance with the fourth embodiment.
Figure 6B:
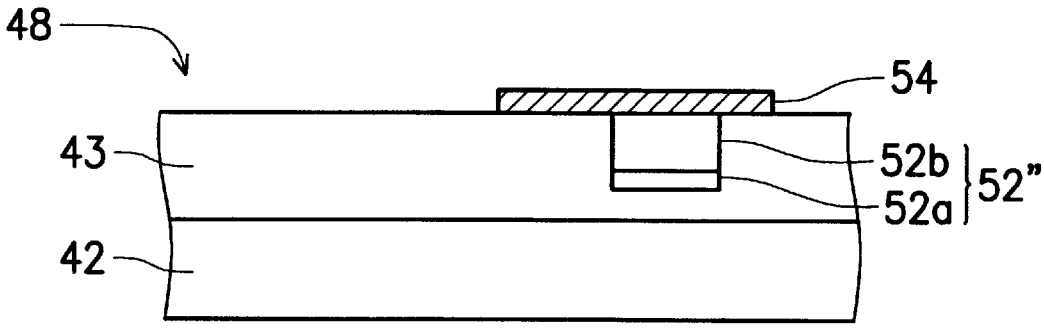

Referring to FIGS. 6A and 6B, FIGS. 6A shows a cross-sectional view of a pixel area of the front plate 40 along the a—a line shown in FIG. 3A in accordance with the fourth embodiment. And FIGS. 6B shows a cross-sectional view of a bonding area of the front plate 40 along the b—b line shown in FIG. 3A in accordance with the fourth embodiment.

The difference between the third and the fourth embodiments is the structure of the auxiliary electrode 52. The auxiliary electrode 52 according to the fourth embodiment is a two-layered structure comprising a main conducting layer 52*b* and an first medium layer 52*a*. The first medium layer 52*a* is used to eliminate the stress between the main conducting layer 52*b* and the glass substrate 42. The second medium layer 52*c* is omitted in the fourth embodiment.

Fifth and Sixth Embodiments

Figure 7A:
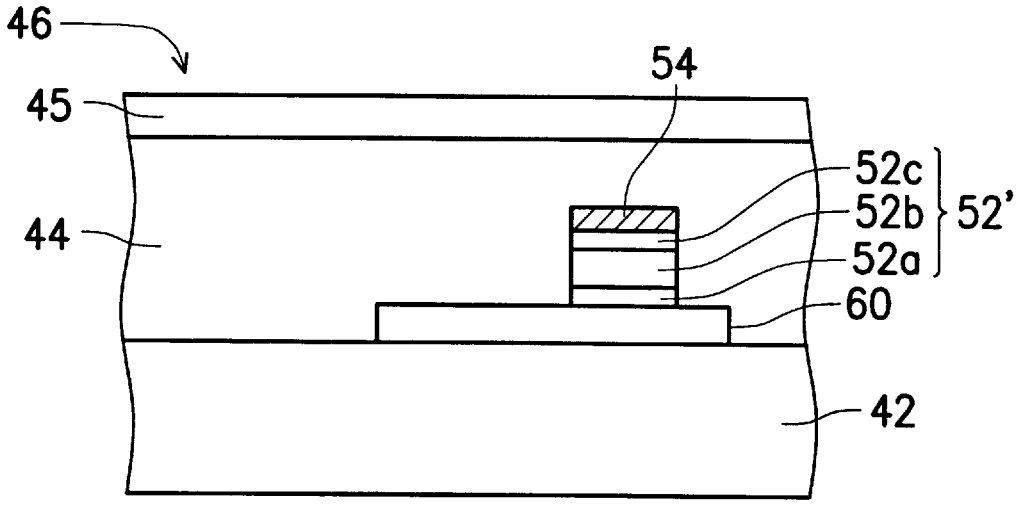
FIGS. 7A and 7B are cross-sectional views of a pixel area and a bonding area, respectively, of the front plate along the a—a and the b—b lines shown in FIG. 7A in accordance with the fifth embodiment.
Figure 7B:
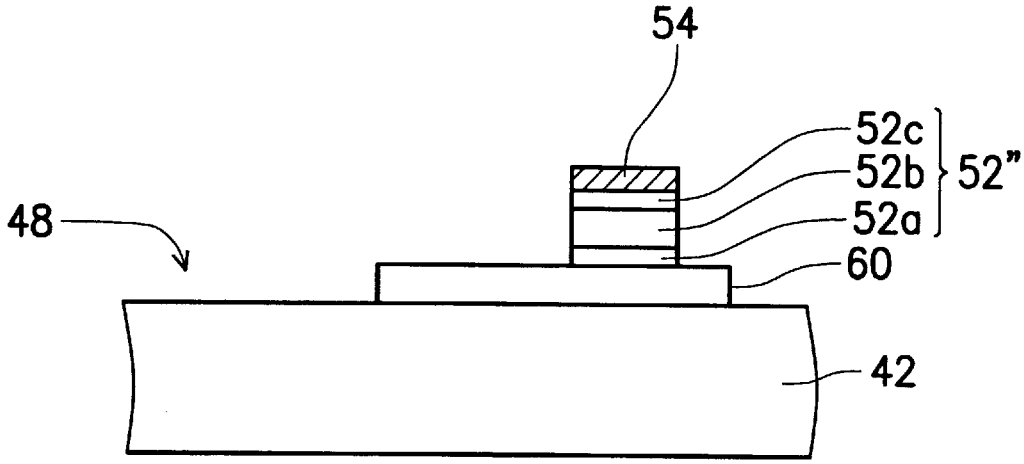

Referring to FIGS. 7A and 7B, FIGS. 7A shows a cross-sectional view of a pixel area of the front plate 40 along the a—a line shown in FIG. 3A in accordance with the fifth embodiment. And FIGS. 7B shows a cross-sectional view of a bonding area of the front plate 40 along the b—b line shown in FIG. 3A in accordance with the fifth embodiment.

According to this embodiment, the front plate 40 of the PDP at least comprises a glass substrate 42 divided into a pixel area 46 and a bonding area 48, a sustaining electrode 60 formed on the glass substrate 42, a auxiliary electrode 52 formed on the top of the sustaining electrode 60, a protecting electrode 54 formed on the top of the auxiliary electrode 52, a dielectric layer 44 covered the glass substrate 42, and a MgO layer 45 formed covering the top of the dielectric layer 44.

The auxiliary electrode 52 is constituted of a three-layered structure including a first medium layer 52*a*, a main conducting layer 52*b*, and a second medium layer 52*c*. The first medium layer 52*a* is formed between the maining conducting layer 52*b* and the protecting electrode 54, and the second medium layer 52*c* is formed between the main conducting layer 52*b* and the protecting electrode 54. The auxiliary electrode 52 includes a pixel auxiliary electrode 52' disposed in the pixel area 46 and a bonding auxiliary electrode 52" disposed in the bonding area 48. The dielectric layer 44 and the MgO layer 45 are formed in the pixel area 46 of the glass substrate 42 but not in the bonding area 48. Therefore, the dielectric layer 44 and the MgO layer 45 will cover the pixel auxiliary electrode 52' as shown in FIG. 7A. In FIG. 7B, neither the dielectric layer 44 nor the magnesium oxide layer 45 is formed in the bonding area 48, the bonding auxiliary electrode 52" is only covered by the protecting electrode 54 so as to prevent the bonding auxiliary electrode 52" from being oxidized during the subsequent high temperature process. Preferably, the protecting electrode 54. covers both the bonding auxiliary electrode 52" and the pixel auxiliary electrode 52' as shown in FIGS. 7A and 7B.

The protecting electrode 54 is made of metal oxides as ITO (Indium Tin Oxide), $SnO_2$, or zinc oxide (ZnO). The protecting electrode 54 can be transparent or not.

Figure 8A:
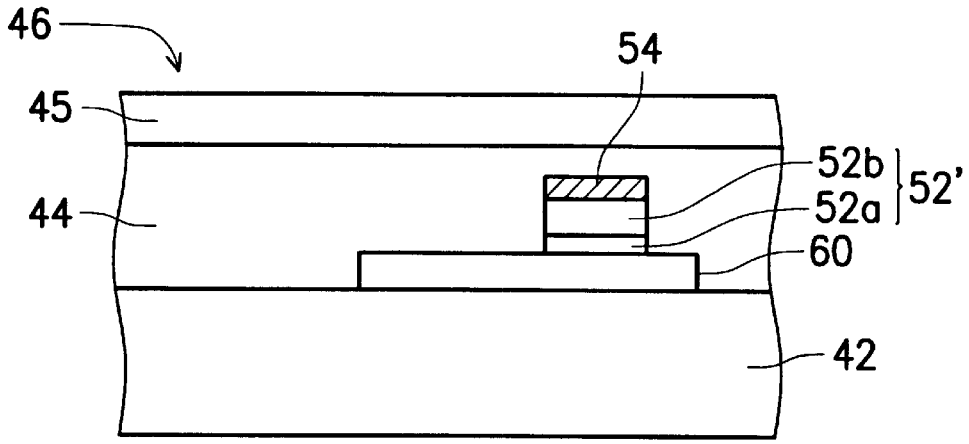
FIGS. 8A and 8B are cross-sectional views of a pixel area and a bonding area of the front plate in accordance with the sixth embodiment.
Figure 8B:
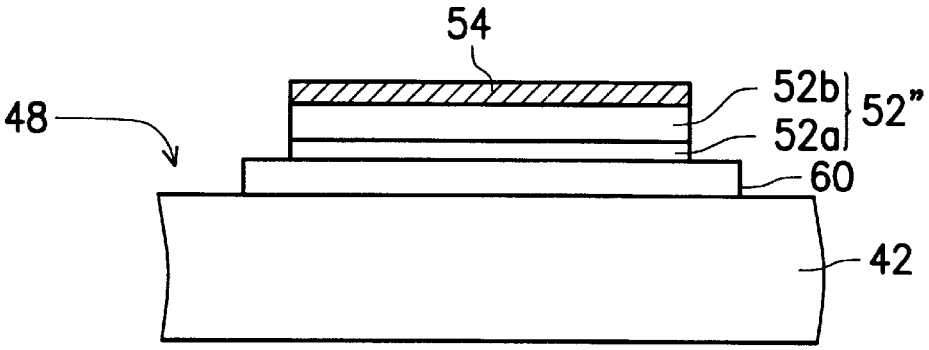

Referring to FIG. 8A and FIG. 8B, FIGS. 8A shows a cross-sectional view of a pixel area of the front plate 40 along the a—a line shown in FIG. 3A in accordance with the sixth embodiment, and FIGS. 8B shows a cross-sectional view of a bonding area of the front plate 40 along the b—b line shown in FIG. 3A in accordance with the sixth embodiment.

The difference between the fifth and the sixth embodiments is the structure of the auxiliary electrode 52. The auxiliary electrode 52 according to the sixth embodiment is a two-layered structure comprising a main conducting layer 52*b* and an first medium layer 52*a*. The first medium layer 52*a* is used to eliminate the stress between the main conducting layer 52*b* and the glass substrate 42. The second medium layer 52*c* is omitted in the sixth embodiment.

FABRICATION METHOD FOR THE FRONT PLATE OF A PDP:

The followings are the detailed descriptions of the fabrication method for forming the front plate of a PDP.

FIG. 9A through FIG. 9D are cross-sectional views illustrating steps involved in the process for fabricating a front plate of a PDP according to the aforementioned third embodiment of the present invention.

Figure 9A:
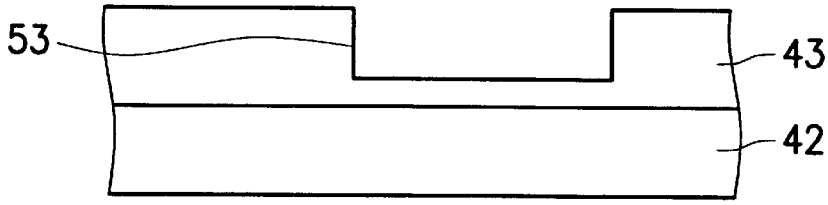
FIG. 9A through FIG. 9D are cross-sectional views illustrating steps involved in the process for fabricating a PDP having an oxidation-resistive electrode according to the aforementioned third embodiment of the present invention.

Referring to FIG. 9A, a glass substrate 42 is provided, a buffer layer 43, such as silicon oxide, is then formed on the glass substrate 42 by a screen printing method. A trench 53 is formed on the buffer layer 43 by a photolithography and an etching processes.

Figure 9B:
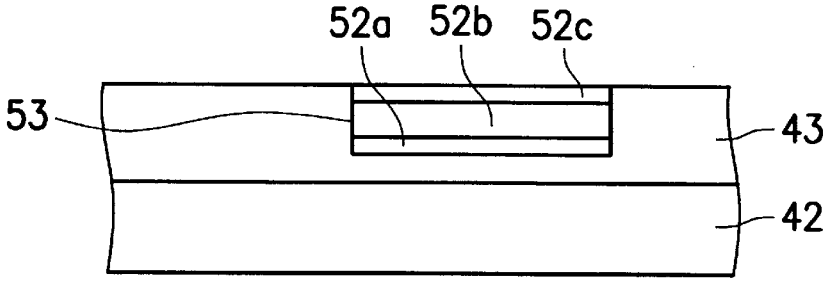

Referring to FIG. 9B, an auxiliary electrode 52 is deposited into the trench 53 via evaporation or sputtering process. For example, a first medium layer 52*a*, typically made of Cr metal, is deposited on the bottom of the trench 53. Then, a main conducting layer 52*b*, typically made of Cu metal, is formed on the first medium layer 52*a*, and finally a second medium layer 52*c*, typically made of Cr, is formed on the main conducting layer 52*b*. The glass substrate 42 is divided into a pixel area 46 and a bonding area 48, and the auxiliary electrode 52 is also defined as a pixel auxiliary electrode 52' disposed in the pixel area 46 and a bonding auxiliary electrode 52" disposed in the bonding area 48.

Figure 9C:
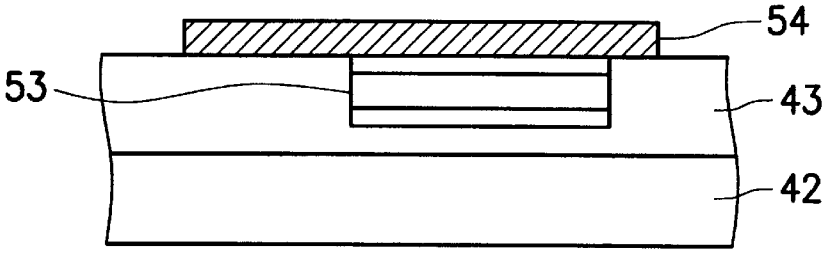

Referring to FIG. 9C, a protecting electrode 54 is formed by a sputtering and photolithographing process. First, a metal oxide layer, such as ITO or $SiO_2$, is sputtered on the glass substrate 42, and is then patterned by a photolithography process to form the protecting electrode 54 above the auxiliary electrode 52.

Figure 9D:
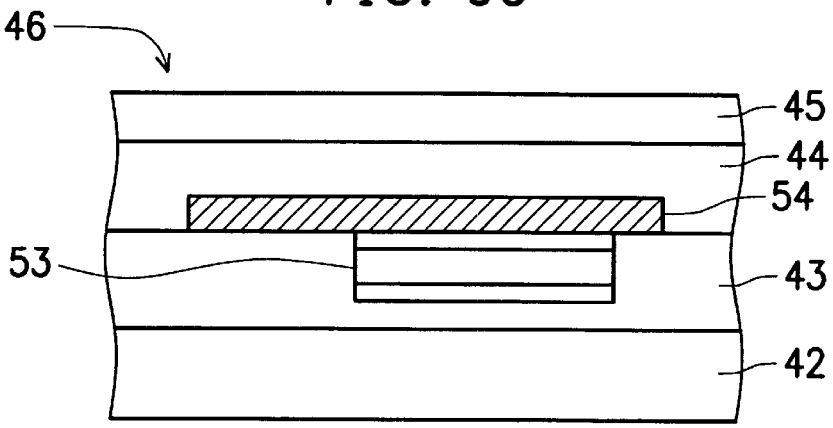

Referring to FIG. 9D, a dielectric layer 44 and a MgO layer 45 are sequentially deposited over the protecting electrode 54 and the buffer layer 43 in the pixel area 46. The dielectric layer 44 is deposited by, for example, a screen printing method. The MgO layer 45 is deposited by, for example, an evaporation or a sputtering method.

On the other hand, as described in the first embodiment, a trench 50 is formed by etching the glass substrate 42 directly. Thereby, the auxiliary electrode 52 is inlaid into the trench 50 formed in the glass substrate 42 as shown in FIGS. 3B and 3C.

Further, as described in the second and the fourth embodiments, the auxiliary electrode 52 is characterized by a two-layered structure comprised of a first medium layer 52*a* and a main conducting layer 52*b* formed sequentially via a an evaporation or a sputtering method.

Figure 10A:
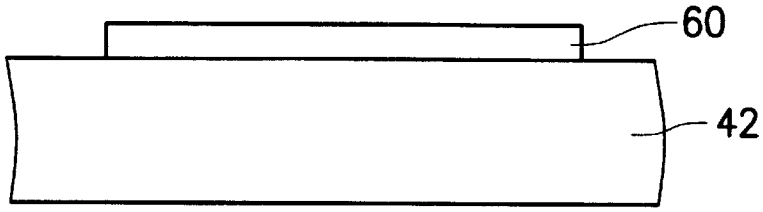
FIG. 10A through FIG. 10C are cross-sectional views illustrating the steps involved in fabricating a PDP having an oxidation-resistive electrode according to the fifth embodiment of the present invention.
Figure 10B:
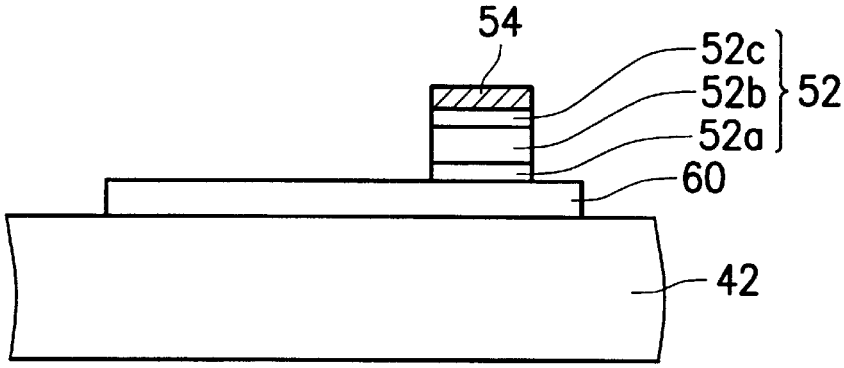
Figure 10C:
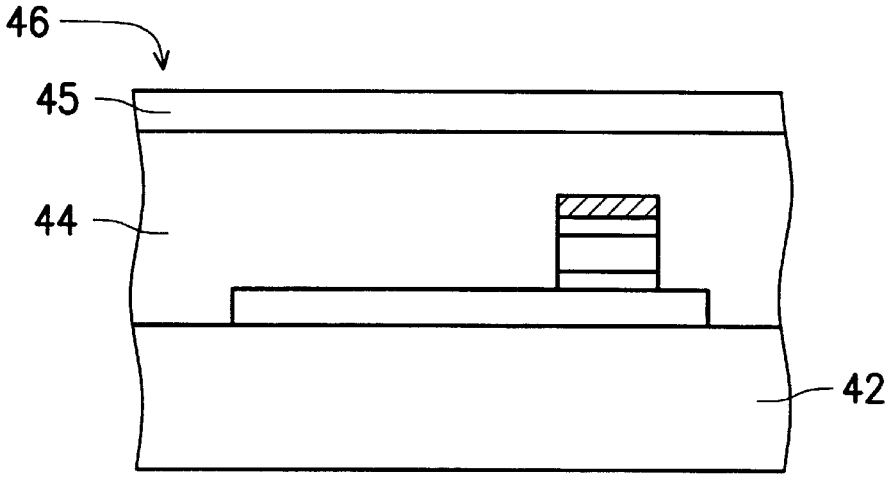

FIG. 10A through FIG. 10C are cross-sectional views illustrating the steps involved in fabricating the front plate of a PDP according to the fifth embodiment of the present invention.

Referring to FIG. 10A, a glass substrate 42 is provided. A sustaining electrode 60 (also called as a transparent electrode) is then formed by sputtering a metal oxide layer on the glass substrate 42. The sustaining electrode is usually constituted of ITO (Indium Tin Oxide) or $SnO_2$. The metal oxide layer is then patterned by a etching process to form the sustaining electrode 60 on the glass substrate 42.

Referring to FIG. 10B, an auxiliary electrode 52 is then deposited on the sustaining electrode 60. The auxiliary electrode 52 is constituted of a first medium layer 52*a*, a main conducting layer 52*b*, and a second medium layer 52*c*. These layers are deposited sequentially stacked on the sustaining electrode 60 by evaporation or sputtering.

Usually, the first and second medium layer 52*a* and 52*c* are made by Cr metal, and the main conducting layer 52*b* is made by Cu metal. Then, a protecting electrode is formed on the auxiliary electrode 52. A metal oxide layer, such as ITO (Indium Tin Oxide), $SnO_2$, or ZnO, is deposited on top of the second medium layer 52*c* by sputtering.

Referring to FIG. 10C, a dielectric layer 44, made of silicon oxide, and a MgO layer 45 are deposited sequentially over the sustaining electrode 60 and the auxiliary electrode 52 in the pixel area 46. The dielectric layer 44 is deposited via a screen printing process, and the MgO layer 45 is deposited by evaporation or sputtering.

As described in the sixth embodiment, the auxiliary electrode 52 is a two-layered structure constituted of a first medium layer 52*a* and a main conducting layer 52*b*. It is worthy of note that, in the sixth embodiment of the present invention, the patterns of the protecting electrode 54 and the auxiliary electrode 52 can be defined at the same time by a single etching process. The first medium layer 52*a* is made of Cr metal, the main conducting layer 52*b* is made of Cu metal, and the protecting layer 54 is made of ITO. Furthermore, the etching rate for etching ITO is about one tenth of the etching rate for etching Cu or Cr, so the ITO layer will not be over etched when etching the Cu or Cr layer. Therefore, the sustaining electrode 60 and the protecting electrode 54, constituting a ITO/Cr/Cu structure, can be formed in one etching process and the manufacturing cost can be reduced.

In the present invention, a high temperature heating process (about 500° C. to about 600° C.) still be needed to sinter the above-described dielectric layer 44 of a PDP, a protecting layer 54 is formed to prevent the bonding auxiliary electrode 52" from being oxidized easily during the heating process.

The foregoing description of the preferred embodiments of this invention has been presented for purposes of illustration and description. Obvious modifications or variations are possible in light of the above teaching. The embodiments are chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A front plate of a plasma display panel (PDP), comprising:

a glass substrate comprising a pixel area, a bonding area, and a trench;

an auxiliary electrode embedded in the trench of the glass substrate, the auxiliary electrode including a pixel auxiliary electrode positioned at the pixel area and a bonding auxiliary electrode positioned at the bonding area; and a protecting electrode disposed above the bonding auxiliary electrode so that the bonding auxiliary electrode is covered by the protecting electrode and is not oxidized during sequential processes.

2. The front plate of the PDP as claimed in claim 1 wherein the auxiliary electrode comprises a main conducting layer positioned under the protecting electrode and a first medium layer positioned under the main conducting layer.

3. The front plate of the PDP as claimed in claim 2 wherein the first medium layer is positioned between the main conducting layer and the glass substrate, and the first medium is used to eliminate the stress between the main conducting layer and the glass substrate.

4. The front plate of the PDP as claimed in claim 2 wherein the auxiliary electrode comprises a second medium layer positioned above the main conducting layer, and is used to eliminate the stress between the main conducting layer and the protecting electrode.

5. The front plate of the PDP as claimed in claim 4 wherein the main conducting layer is made of copper (Cu), the first and the second medium layer are made of chromium (Cr).

6. The front plate of the PDP as claimed in claim 1 wherein the protecting electrode is made of a layer of metal-oxide.

7. The front plate of the PDP as claimed in claim 6 wherein the protecting electrode is selected from the group of ITO (Indium Tin Oxide), ZnO (Zinc Oxide), and $SnO_2$ (Stannum dioxide).

8. A method for fabricating a plasma display panel (PDP), comprising the steps of:

(a) providing a glass substrate having a pixel area and a bonding area;

(b) forming a trench in the glass substrate;

(c) forming an auxiliary electrode in the trench, the auxiliary electrode comprising a pixel auxiliary electrode disposed in the pixel area and a bonding auxiliary electrode disposed in the bonding area; and (d) forming a protecting electrode over the bonding auxiliary electrode to prevent the bonding auxiliary electrode from oxidation during sequential processes.

9. A method for fabricating a plasma display panel (PDP), comprising the steps of:

(a) providing a glass substrate having a pixel area and a bonding area;

(b) forming a dielectric layer on the glass substrate;

(c) forming a trench in the dielectric layer;

(d) forming an auxiliary electrode in the trench, the auxiliary electrode comprising a pixel auxiliary electrode disposed in the pixel area and a bonding auxiliary electrode disposed in the bonding area; and (e) forming a protecting electrode over the bonding auxiliary electrode to prevent the bonding auxiliary electrode from oxidation during sequential processes.

10. A front plate of a plasma display panel (PDP) comprising:

a glass substrate having a pixel area and a bonding area;

a buffer layer disposed on the glass substrate, the buffer layer having a trench;

an auxiliary electrode embedded in the trench of the buffer layer, the auxiliary electrode comprising a pixel auxiliary electrode positioned at the pixel area and a bonding auxiliary electrode positioned at the bonding area; and a protecting electrode disposed above the bonding auxiliary electrode so that the bonding auxiliary electrode is covered by the protecting electrode and is not oxidized during subsequent processes.

11. The front plate of the PDP as claimed in claim 10 wherein the auxiliary electrode comprises a main conducting layer positioned under the protecting electrode and a first medium layer positioned under the main conducting layer.

12. The front plate of the PDP as claimed in claim 11 wherein the first medium layer is positioned between the main conducting layer and the buffer layer, and the first medium eliminates the stress between the main conducting layer and the buffer layer.

13. The front plate of the PDP as claimed in claim 11 wherein the auxiliary electrode comprises a second medium layer positioned above the main conducting layer, and eliminates the stress between the main conducting layer and the protecting electrode.

14. The front plate of the PDP as claimed in claim 13 wherein the main conducting layer is made of copper (Cu), and the first and second medium layers are made of chromium (Cr).

15. The front plate of the PDP as claimed in claim 10 wherein the protecting electrode is a layer of metal-oxide.

16. The front plate of the PDP as claimed in claim 15 wherein the protecting electrode is selected from the group of ITO (Indium Tin Oxide), ZnO (Zinc Oxide), and $SnO_2$ (Stannum dioxide).

17. A front plate of a plasma display panel (PDP), comprising:

a glass substrate having a pixel area and a bonding area; and a scanning electrode comprising:

a protecting electrode disposed on the glass substrate; and an auxiliary electrode disposed between the protecting electrode and the glass substrate and covered by the protecting electrode, the auxiliary electrode including a pixel auxiliary electrode positioned at the pixel area and a bonding auxiliary electrode positioned at the bonding area, wherein the protecting electrode in the bonding area is connected to an external driving circuit.

18. The front plate of the PDP as claimed in claim 17 wherein the glass substrate comprises a trench, and the auxiliary electrode is embedded in the trench of the glass substrate.

19. The front plate of the PDP as claimed in claim 17 wherein the front plate further comprises a buffer layer disposed on the glass substrate, the buffer layer has a trench, and the auxiliary electrode is embedded in the trench of the buffer layer.

* * * * *